US010240570B2

(12) United States Patent
Bethmann et al.

(10) Patent No.: US 10,240,570 B2
(45) Date of Patent: Mar. 26, 2019

(54) RECIPROCATING PISTON INTERNAL COMBUSTION ENGINE INCLUDING A SENSOR SYSTEM ON A GAS EXCHANGE VALVE

(71) Applicant: Robert Bosch GmbH, Stuttgart (DE)

(72) Inventors: Andreas Bethmann, Rutesheim (DE); Andre Yashan, Stuttgart (DE); Markus Stalitza, Schwaebisch Gmuend (DE); Armin Hassdenteufel, Sachsenheim-Ochsenbach (DE); Herbert Kolly, Kleinsachsenheim (DE); Jochen Hofstaetter, Sinsheim (DE)

(73) Assignee: ROBERT BOSCH GMBH, Stuttgart (DE)

( * ) Notice: Subject to any disclaimer, the term of this patent is extended or adjusted under 35 U.S.C. 154(b) by 161 days.

(21) Appl. No.: 14/967,540

(22) Filed: Dec. 14, 2015

(65) Prior Publication Data

US 2016/0169183 A1 Jun. 16, 2016

(30) Foreign Application Priority Data

Dec. 15, 2014 (DE) ..... 10 2014 118 661

(51) Int. Cl.
*F01L 1/18* (2006.01)
*F02M 65/00* (2006.01)
(Continued)

(52) U.S. Cl.
CPC ..... *F02M 65/005* (2013.01); *F01L 1/18* (2013.01); *F01L 1/185* (2013.01); *F01L 1/46* (2013.01);
(Continued)

(58) Field of Classification Search
CPC ..... F02M 65/005; F01L 1/18; F01L 1/185; F01L 1/46; F01L 3/10; F01L 2101/00; F01L 2105/00; F01L 2820/045
(Continued)

(56) References Cited

U.S. PATENT DOCUMENTS

2004/0065854 A1* 4/2004 Lammert ..... F01L 9/02 251/29
2008/0035870 A1* 2/2008 Wygnanski ..... F01L 1/185 251/129.15
(Continued)

FOREIGN PATENT DOCUMENTS

DE 19960561 C1 1/2001
DE 199 44 698 3/2001

*Primary Examiner* — Laert Dounis
*Assistant Examiner* — Kelsey L Stanek
(74) *Attorney, Agent, or Firm* — Norton Rose Fulbright US LLP; Gerard Messina

(57) ABSTRACT

A reciprocating piston internal combustion engine includes: a sensor system on a gas exchange valve which has a valve head situated at a first end of a valve stem; a lever element which engages at a second end of the valve stem and which is designed to actuate the gas exchange valve by displacing the valve head; a detection element which, upon actuation of the gas exchange valve, is displaced along a displacement path; and a sensor device configured to ascertain a position of the detection element. The sensor device is situated in such a way that the detection element, during a displacement along a portion of the displacement path, moves predominantly in a movement toward the sensor device or away from the same, thereby providing a measurement of valve timing of the gas exchange valve.

12 Claims, 3 Drawing Sheets

(51) Int. Cl.
*F01L 1/46* (2006.01)
*F01L 3/10* (2006.01)

(52) U.S. Cl.
CPC ..... *F01L 3/10* (2013.01); *F01L 2101/00* (2013.01); *F01L 2105/00* (2013.01); *F01L 2820/045* (2013.01)

(58) Field of Classification Search
USPC ..... 123/90.39–90.45
See application file for complete search history.

(56) References Cited

U.S. PATENT DOCUMENTS

2009/0293597 A1 12/2009 Andrie
2013/0233265 A1 9/2013 Zurface et al.

* cited by examiner

RECIPROCATING PISTON INTERNAL COMBUSTION ENGINE INCLUDING A SENSOR SYSTEM ON A GAS EXCHANGE VALVE

BACKGROUND OF THE INVENTION

1. Field of the Invention

The present invention relates to a reciprocating piston internal combustion engine. In particular, the present invention relates to a reciprocating piston internal combustion engine including a sensor device for at least indirectly ascertaining a valve lift of a gas exchange valve.

2. Description of the Related Art

In motor vehicles which include a reciprocating piston internal combustion engine, generally gas exchange valves, for example two intake valves and two exhaust valves per cylinder, are used to introduce air and/or an air/fuel mixture and/or to discharge exhaust gases. A gas exchange valve may be actuated via a lever element, for example a rocker arm, a pivot lever, a cam follower and/or a roller cam follower, and a cam element of a camshaft engaging thereon.

An actuating degree of a gas exchange valve is usually ascertained via a position or angle detection of the camshaft and/or of a crankshaft situated on the associated cylinder. The position detection of the crankshaft may be implemented with the aid of a sensor wheel, for example a 60-2 sensor wheel, and a position sensor and/or rotational speed sensor. The position detection of the camshaft is also frequently carried out with the aid of a sensor wheel, for example an encoder wheel having three or four teeth. The opening and closing points in time suitable for a charge cycle of a cylinder, i.e., an exchange of the working medium in the cylinder, or suitable timing of the particular gas exchange valve is/are ascertained, for example by an engine control unit, from an instantaneously ascertained engine state and/or from characteristic maps and/or from a calculation and set, for example, with the aid of a camshaft adjuster and/or a phase adjuster of the camshaft. The values of the position detection of the camshaft and/or of the crankshaft are incorporated in this process. The accuracy of the opening and closing points in time or of the timing of the gas exchange valve may thus be limited by the accuracy of the position determination of a phase angle of the camshaft relative to the crankshaft. Furthermore, mechanical tolerances, such as in a valve train of the gas exchange valve and/or a sensor system for the position detection of the crankshaft and/or camshaft, and electrical tolerances in the sensor system may only be partially compensated.

Dethrottling concepts, such as Miller and Atkinson cycles, may provide one approach for meeting future requirements in regard to a fuel consumption of an internal combustion engine. With such a dethrottling, a closing point in time of the gas exchange valve, such as of the intake valve, may be used to control a fresh air amount in the cylinder in such a way that lower charge cycle losses may be experienced and the internal combustion engine or the reciprocating piston internal combustion engine may be operated with higher efficiency. In the case of both cycles, the closing point in time of the gas exchange valve is in a range of a maximum piston speed, and thus in a range of a maximum change in cylinder volume per change of a crankshaft angle. This results in a high sensitivity of a calculation of the fresh air amount with respect to tolerance-induced errors in the position detection of the camshaft and/or of the crankshaft. In other words, tolerance-induced errors in the position detection of the camshaft and/or of the crankshaft may result in errors in the calculation of the charge of a cylinder, so-called charge errors. Depending on the degree of the charge error, this may, in turn, result in misfires, increased emissions, and a reduced drivability or a performance reduction of the motor vehicle.

Tolerances in the position detection of the camshaft and/or of the crankshaft may be at least partially compensated, for example, by directly determining an actuating degree and/or a position of the gas exchange valve. Frequently, a variable-phase drive system of the camshaft relative to the crankshaft, i.e., a camshaft adjuster, is used for this purpose, which may be used as an element for compensating an ascertained position deviation.

A sensor system for determining a valve lift of a gas exchange valve is known from published German patent application document DE 199 44 698 A1, in which the valve lift is determined with the aid of a permanent magnet situated on the rocker arm and a magnetic field sensor.

BRIEF SUMMARY OF THE INVENTION

Specific embodiments of the present invention may advantageously make it possible to provide a reciprocating piston internal combustion engine in which an actuating degree or a position of a gas exchange valve may be determined with increased accuracy, whereby, among other things, an increase in the efficiency of the internal combustion engine may be made possible.

According to one aspect of the present invention, a reciprocating piston internal combustion engine is introduced, which includes a gas exchange valve having a valve head which is situated at a first end of a valve stem. The reciprocating piston internal combustion engine furthermore includes a lever element which engages at a second end of the valve stem and which is designed to actuate the gas exchange valve by displacing the valve head. The reciprocating piston internal combustion engine moreover includes a detection element which, upon actuation of the gas exchange valve, is displaced along a displacement path, and a sensor device which is designed to ascertain a position of the detection element. The reciprocating piston internal combustion engine according to the present invention is characterized in particular in that the sensor device is situated in such a way that the detection element, during a displacement of the same along a portion of the displacement path in which the detection element is situated closer to the sensor device than in other portions of the displacement path, moves predominantly in a movement toward the sensor device or away from the same.

The wording "predominantly in a movement toward the sensor device or away from the same" may be understood as follows. The movement and/or displacement of the detection element along the displacement path may have a first movement component which, depending on the pivot direction of the lever element, may be directed in the direction or opposite direction of a normal vector of an outer surface of the sensor device which faces the lever element, for example. A second movement component of the movement or displacement of the detection element may be directed orthogonally to the first movement component. In the arrangement according to the present invention of the sensor device relative to the lever element and/or to the detection element, the first movement component is greater than the second movement component, so that the detection element moves predominantly toward the sensor device or away from the same. In other words, the detection element does not move along the displacement path tangentially past the sensor device, but the displacement path is directed toward the sensor device.

Ideas regarding specific embodiments of the present invention may be considered to be based, among other things, on the concepts and findings described hereafter. As described at the outset, an actuating degree and/or a position and/or a location and/or an opening angle of the gas exchange valve is usually ascertained via a position or angle detection of the camshaft and/or of a crankshaft situated on the associated cylinder. The opening and closing points in time suitable for a charge cycle of a cylinder, i.e., for an exchange of the working medium in the cylinder, or suitable timing of the particular gas exchange valve is/are ascertained, e.g., by an engine control unit from an instantaneously ascertained engine state and/or from characteristic maps and/or from a calculation and set, for example, with the aid of a camshaft adjuster and/or a phase adjuster of the camshaft. The values of the position detection of the camshaft and/or of the crankshaft are incorporated in this process. In conventional engines including conventional crankshaft and/or camshaft sensor systems, an accuracy of the opening and closing points in time or of the timing of the gas exchange valve may thus at best be as precise as the accuracy of the position determination of a phase angle of the camshaft relative to the crankshaft. Moreover, mechanical tolerances, such as in a valve train of the gas exchange valve and/or a sensor system for the position detection of the crankshaft and/or camshaft, and electrical tolerances in the sensor system may only be partially compensated, and tolerance-induced errors in the position detection of the camshaft and/or of the crankshaft may result in errors in the charge of a cylinder, i.e., in charge errors. Customary tolerances in the position detection of a tolerance chain from the mechanical top dead center of a cylinder to a location of the gas exchange valve, which may correspond to an overall tolerance of a reciprocating piston internal combustion engine, may be in a range of approximately +/−4° crankshaft angle. Using conventional valve timing, this may result in charge errors of approximately +/−10%. Since an adaptation of the timing of the gas exchange valve may be sensitive to tolerances in the position detection of the camshaft and/or of the crankshaft, for example in dethrottling concepts such as Miller and/or Atkinson cycles, it may be necessary to cut the overall tolerance of the reciprocating piston internal combustion engine approximately in half, in order not to exceed a charge error of approximately +/−10% even in the case of such dethrottling concepts.

A position of the camshaft is frequently detected close to or on a camshaft adjuster. The position of the camshaft may also be detected at one end of the camshaft, which may be situated opposite of a further end of the camshaft, at which the camshaft adjuster and/or a drive system of the camshaft may be situated. In other words, the position of the camshaft may also be detected at that end of the camshaft at which the camshaft adjuster and/or the drive system of the camshaft is not situated. Present dethrottling concepts may require at least a two-point valve lift switching. The valve lift switching and a further valve train mechanical system may be subject to tolerances and thereby result in deviations in the valve timing. These deviations are not detectable with the aid of existing concepts for determining a position of the gas exchange valve, and consequently are also not compensatable. Present requirements in regard to an accuracy of the position detection or angle detection of the reciprocating piston internal combustion engine may only be met with high complexity, for example when parts of the valve train (sensor system and mechanics) are produced more exactly or the individual parts are exactly measured prior to installation. Deviation resulting from wear during operation may also be only partially identified and compensated, and it is not possible to check whether the valve train in the cylinder head was properly assembled after manufacture or after a repair in a repair shop. Charge errors during the switching between operating modes may also result in misfires.

Due to the reciprocating piston internal combustion engine according to the present invention including a sensor device for determining a position of the gas exchange valve, which may correspond to a position sensor system on one or multiple gas exchange valves, for example, it is possible to adapt and/or adjust the position detection of the camshaft and/or of the crankshaft with the aid of an additional adaptive algorithm. In this way, a considerable portion of the tolerances of the position detection of the camshaft and/or of the crankshaft which are not compensatable may be compensated. This, in turn, may make it possible to meet the high requirements in regard to an accuracy of the position detection of the camshaft and/or of the crankshaft, in particular with respect to dethrottling concepts such as Miller and/or Atkinson cycles. Furthermore, the sensor device according to the present invention may make it possible to detect events such as "gas exchange valve opens or closes," whereby also deviations in the timing and/or in an opening angle of the gas exchange valve are identified, and corresponding measures or corrections may be taken, such as in an engine control.

In summary, in particular the advantages described hereafter may result from the reciprocating piston internal combustion engine according to the present invention including a sensor device for ascertaining the position of the gas exchange valve. High accuracy requirements due to dethrottling concepts such as Miller and Atkinson cycles may be met, a risk of ignition misfires when switching between operating modes due to charge errors may be low, and a simple and robust diagnosis of a valve lift switching may be possible, since the opening angle of the gas exchange valve changes significantly and may be clearly identified via the detection of the events "gas exchange valve opens and closes." Furthermore, an installation check whether the valve train in the cylinder head was properly assembled may be carried out easily and quickly after manufacture or in the repair shop. It is also possible to keep variations of the mechanical tolerances, for example due to wear in the valve train, within a narrow tolerance range. Cylinder-individual deviations of the timing and/or of opening angles of the gas exchange valves may be identified with a sensor or a sensor device on every cylinder, thus allowing cylinder-individual charge differences to be inferred. A defective hydraulic valve clearance compensating element may be identified, since the timing and/or opening angle of the gas exchange valve may change significantly. The sensor device may be used in all valve trains, regardless of the type of camshaft adjustment and/or valve lift switching.

The lever element may denote a rocker arm, a pivot lever, a cam follower and/or a roller cam follower, for example.

According to one specific embodiment of the present invention, the detection element is designed integrally with the lever element. In other words, the detection element need not be provided as a separate component, but may be part of the lever element. For example, the detection element may be an area of the lever element, such as one end and/or an outer surface of the lever element. This may be advantageous with respect to a limited available installation space in or on the reciprocating piston internal combustion engine. Furthermore, conventionally used lever elements need not necessarily be modified.

According to one specific embodiment of the present invention, the detection element is situated at one end of the lever element, which is situated opposite of a rotational axis of the lever element in the longitudinal extension direction of the lever element. In other words, the lever element may be pivotably mounted on a rotational axis, and the detection element may be situated in an area close to the end of the lever element which is situated opposite of the rotational axis.

According to one specific embodiment of the present invention, the detection element is situated on the valve stem. This embodiment may also be advantageous with respect to a limited available installation space in or on the reciprocating piston internal combustion engine. The detection element may be designed as a component which is separate from the lever element.

For example, according to one specific embodiment of the present invention, the detection element may be designed integrally with a valve disk situated on the valve stem. In other words, the detection element may be at least a part or a portion of the valve disk. This may advantageously allow a determination of the position of the gas exchange valve, for example without changing a mass distribution and/or a center of gravity and/or inertia properties of the gas exchange valve.

According to one specific embodiment of the present invention, the sensor device is designed to contactlessly ascertain the position of the detection element. For example, the sensor device may include an optical, an acoustic, a capacitive and/or an inductive sensor element and/or a magnetic field sensor element, such as a Hall element or a magnetoresistive element. A contactless ascertainment of the position of the detection element may minimize wear and maintenance work. In this way, an installation and/or a retrofit and/or a repair of the sensor device may also be facilitated.

According to one specific embodiment of the present invention, the sensor device includes a Hall-effect sensor for ascertaining the position of the detection element. A Hall-effect sensor may be advantageous in particular with respect to a small overall size, high sensitivity, and high reliability of the sensor device.

According to one specific embodiment of the present invention, the sensor device includes a Hall-effect sensor having an integrated circuit, an analog interface for outputting an analog sensor signal and/or a digital interface for outputting a digital sensor signal. In this way, an intelligent sensor device may be provided, which may allow a measured variable, such as a magnetic field strength and/or a magnetic flux and/or a magnetic field change, to be processed, for example independently of a control unit. Via the analog and/or digital interface(s), furthermore an analog and/or a digital sensor signal may be transmitted to a further vehicle component, such as an engine control unit, and be used, for example, for a comparison with a position detection of the camshaft and/or the crankshaft. This, in turn, may allow and/or simplify a compensation of tolerances in the position detection of the camshaft and/or of the crankshaft.

According to one specific embodiment of the present invention, the sensor device is designed to output the digital sensor signal at a valve lift of the valve head of the gas exchange valve of more than 2%, preferably more than 5%. The valve lift may be standardized to a maximum valve lift, for example. The digital sensor signal may be supplied to an engine control unit, for example, and be processed by the same, so that, for example, the valve timing may be ascertained with precision and/or an engine control may be improved, for example with respect to an efficiency of the reciprocating piston internal combustion engine.

According to one specific embodiment of the present invention, the sensor device is designed to output the digital sensor signal at a valve lift of the valve head of the gas exchange valve of more than 0.3 mm, preferably more than 0.5 mm. Starting at such a valve lift, for example, a valve opening cross section may be sufficiently large for a charge cycle, or starting at this valve lift, a flow which is relevant for the charge cycle may set in. Outputting and/or transmitting the digital sensor signal starting at this valve lift, for example to an engine control unit, may improve engine control.

It is pointed out that several of the possible features and advantages of the present invention are described herein with reference to different specific embodiments. Those skilled in the art will recognize that the features may be suitably combined, adapted or exchanged to arrive at further specific embodiments of the present invention.

DETAILED DESCRIPTION OF THE INVENTION

Figure 1:
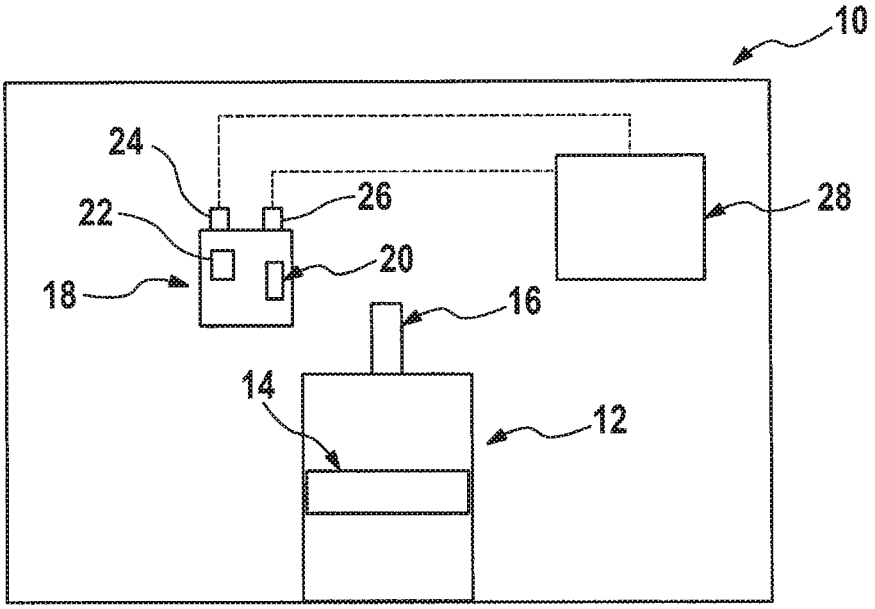
FIG. 1 shows a reciprocating piston internal combusting engine according to one specific embodiment of the present invention.

The figures are only schematic representations and are not true to scale. Identical reference numerals denote identical or identically-acting features in the figures.

FIG. 1 shows a reciprocating piston internal combusting engine 10 according to one specific embodiment of the present invention.

Reciprocating piston internal combustion engine 10 includes a cylinder 12 having a piston 14 situated displaceably therein. Reciprocating piston internal combustion engine 10 may include multiple such cylinders 12, each having a piston 14. Piston 14 may be operatively connected to a crankshaft and be displaced together with the same.

Reciprocating piston internal combustion engine 10 furthermore includes a gas exchange valve 16. For example, gas exchange valve 16 may be an intake valve for introducing an air/fuel mixture into cylinder 12, or an exhaust valve for discharging exhaust gas from cylinder 12. Reciprocating piston internal combustion engine 10 may include multiple such gas exchange valves 16, for example, two gas exchange valves 16, such as one intake valve and one exhaust valve, may be provided per cylinder 12.

Reciprocating piston internal combustion engine 10 furthermore includes a sensor device 18, which is designed to ascertain an actuating degree and/or an opening angle and/or a position of at least a part of gas exchange valve 16, as is described in detail above and below. For this purpose, sensor device 18 includes a sensor element 20 designed as a Hall-effect sensor. Sensor device 18 and/or sensor element 20 furthermore include(s) an integrated circuit 22 for processing a measured variable detected by sensor element 20, such as a detected magnetic field strength and/or a magnetic field change and/or a magnetic flux. For this purpose, integrated circuit 22 may include a microcontroller and/or a memory device for storing measuring data, for example. Moreover, sensor device 18 includes an analog interface 24 for outputting an analog sensor signal and/or a digital interface 26 for outputting a digital sensor signal. The analog sensor signal and/or the digital sensor signal may be transferred and/or transmitted, for example via corresponding electrical lines, to a control unit 28, such as an engine control unit, for further processing and/or for processing of the sensor signals.

Sensor device 18 may also only have one digital interface 26 for outputting the digital sensor signal, which may be used for engine control, for example. In this case, a processing of the analog sensor signal may take place in integrated circuit 22, for example. In this way, sensor device 18 may have a simpler and more cost-effective design.

Figure 2A:
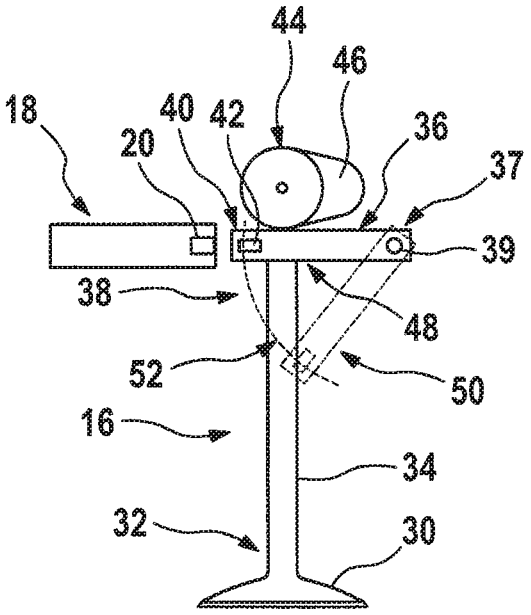
FIG. 2A Related art
FIG. 2A shows a part of a sensor system of a reciprocating piston internal combustion engine known from the related art.

FIG. 2A shows a part of a sensor system of a reciprocating piston internal combustion engine 10 known from the related art.

Reciprocating piston internal combustion engine 10 includes a gas exchange valve 16 having a valve head 30, which is situated at a first end 32 of a rod-shaped valve stem 34.

Moreover, reciprocating piston internal combustion engine 10 includes a lever element 36, which rests against a second end 38 of valve stem 34 situated opposite of first end 32 of valve stem 34 in the longitudinal extension direction of valve stem 34. Lever element 36 is designed as a cam follower. Lever element 36 is mounted rotatably and/or pivotably on a rotational axis 39 at a first end 37 of lever element 36. At a second end 40 of lever element 36 situated opposite of first end 37 of lever element 36 in the longitudinal extension direction of lever element 36, a permanent magnet 42 is situated as a signal generator for determining a position and/or a location of lever element 36.

Adjoining and/or resting against second end 40 of lever element 36, a camshaft 44 which has at least one cam element 46 or a cam lobe for displacing lever element 36 is situated opposite of second end 38 of valve stem 34.

Reciprocating piston internal combustion engine 10 furthermore includes a sensor device 18 for ascertaining a position and/or a location of permanent magnet 42, and thus for indirectly ascertaining a location and/or a position of lever element 36 and/or of gas exchange valve 16. For example, sensor device 18 includes a sensor element 20 designed as a Hall-effect sensor or as a GMR sensor.

During rotation of camshaft 44, cam element 46 pushes onto second end 40 of lever element 36, whereby lever element 36 is pivoted out of a starting position 48 about rotational axis 39 into an end position 50. During pivoting of lever element 36, in turn, second end 40 of lever element 36 pushes against second end 38 of valve stem 34, whereby valve stem 34 and valve head 30 are displaced in the longitudinal extension direction of valve stem 34. For example, gas exchange valve 16 may be closed in the starting position of lever element 36, and may be open in end position 50, or vice versa. If camshaft 44 rotates further until cam element 46 releases second end 40 of lever element 36, lever element 36 again pivots out of end position 50 into starting position 48. For this purpose, lever element 36 and/or valve stem 34 may be preloaded in the direction of starting position 48, for example with the aid of a suitable spring device.

When lever element 36 is pivoted between starting position 48 and end position 50, permanent magnet 42 is displaced along a displacement path 52, the displacement of permanent magnet 42 being detected with the aid of sensor device 18 and/or sensor element 20 via a change in the magnetic field, so that a position and/or location of permanent magnet 42 and indirectly a position and/or location and/or an opening angle of gas exchange valve 16 may be ascertained.

Figure 2B:
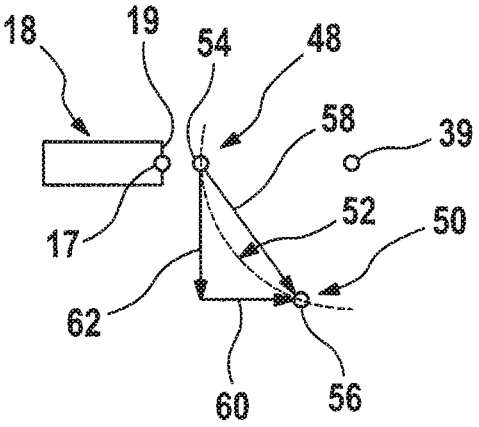
FIG. 2B Related art
FIG. 2B illustrates a displacement of a permanent magnet of the sensor system of FIG. 2A.

FIG. 2B illustrates the displacement of permanent magnet 42 along displacement path 52 of the sensor system of FIG. 2A. When lever element 36 is pivoted out of starting position 48 into end position 52, permanent magnet 42 is displaced from a starting point 54 to an end point 56 along displacement path 52. The movement of permanent magnet 42 may be represented by a motion vector 58. The movement or motion vector 58 of permanent magnet 42 may be broken down into a first movement component 60 and a second movement component 62 which is orthogonal to first movement component 60. Based on a reference point 17 of sensor device 18 and/or based on an outer surface 19 of sensor device 18 which faces lever element 36 at least in its starting position 48, first movement component 60 is directed away from sensor device 18 and/or reference point 17 and/or outer surface 19, or first movement component 60 is directed in parallel to a normal vector of outer surface 19. In contrast, second movement component 62 extends orthogonally to the normal vector of outer surface 19.

Reference point 17 may denote a central point of outer surface 19 of sensor device 18, for example, such as a geometric center of outer surface 19. Reference point 17 may also denote a geometric center of sensor element 20 and/or a center of gravity of sensor element 20. For example, reference point 17 may be situated along a central center line through sensor device 18, which may extend in parallel to a longitudinal extension direction of sensor device 18, for example at one end of sensor device 18.

During a displacement of permanent magnet 42 out of end position 50 into starting position 48, motion vector 58, first movement component 60 and second movement component 62 are each directed in the opposite direction.

In the embodiment known from the related art and shown in FIGS. 2A and 2B, first movement component 60 is always smaller, in absolute terms, than second movement component 62 during a displacement of permanent magnet 42 along displacement path 52. Accordingly, permanent magnet 42 moves farther along second movement component 62 orthogonally to the normal vector of outer surface 19 past sensor device 18 and/or reference point 17 and/or outer surface 19 than it moves along first movement component 60 in parallel or antiparallel to the normal vector of outer surface 19 toward, or away from, sensor device 18 and/or reference point 17 and/or outer surface 19. This means that permanent magnet 42 moves along displacement path 52 predominantly past sensor device 18, than it moves toward, or away from, the same.

The arrangement of sensor device 18 relative to lever element 36, known from the related art, may be referred to as radial sampling based on a pivoting or rotational movement of the lever element along displacement path 52. A sensing direction, i.e., a direction in which sensor element 20 of sensor device 18 essentially detects and/or ascertains the magnetic field generated by permanent magnet 42, extends in parallel to a longitudinal extension direction of lever element 36, at least in starting position 48 of lever element 36.

Figure 3A:
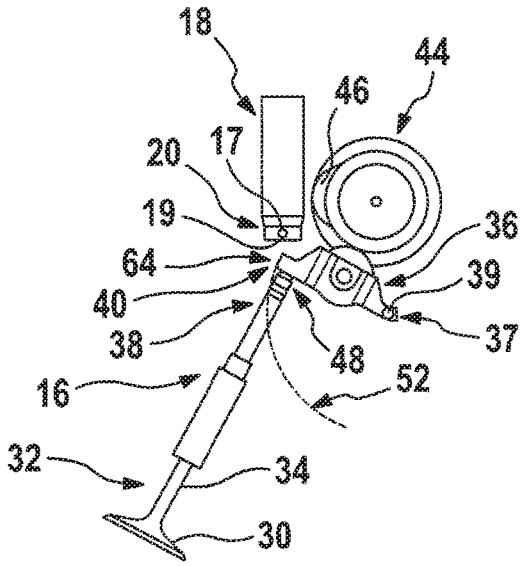
FIG. 3A shows a part of a sensor system of a reciprocating piston internal combustion engine according to one specific embodiment of the present invention.

FIG. 3A shows a part of a sensor system of a reciprocating piston internal combustion engine 10 according to one specific embodiment of the present invention. Unless described otherwise, the part of the sensor system of reciprocating piston internal combustion engine 10 shown in FIG. 3A has the same elements and features as the part shown in FIG. 2A.

Analogously to FIG. 2A, lever element 36, which is designed as a roller cam follower, is pivoted and/or displaced out of a starting position 48 by cam element 46 during rotation of camshaft 44, a detection element 64 situated at second end 40 of lever element 36 being displaced along displacement path 52. The movement or displacement of detection element 64 along displacement path 52 is again picked up and/or ascertained and/or detected with the aid of sensor device 18 having an integrated magnetic element and a sensor element 20 designed as a Hall-effect sensor, so that a position and/or a location and/or an opening angle of gas exchange valve 16 and/or of valve head 30 is/are indirectly ascertainable. Detection element 64 shown in FIG. 3A is designed integrally with lever element 36 at least as a part and/or an area of second end 40 of lever element 36.

Detection element 64 may denote, for example, an edge, an outer surface, a tip and/or another area of second end 40 of lever element 36. To allow detection element 64 to be precisely detected by sensor device 18, lever element 36 may be made from ferromagnetic material, for example, and/or detection element 64 may be designed as a magnetic element which is integrated into lever element 36. Outer surface 19 of sensor device 18 which faces lever element 36 and/or detection element 64 may be spaced apart from detection element 64 and/or from an outer surface of lever element 36 which faces outer surface 19 by at least 0.2 mm, for example by at least 0.5 mm, and preferably by at least 1.0 mm.

Figure 3B:
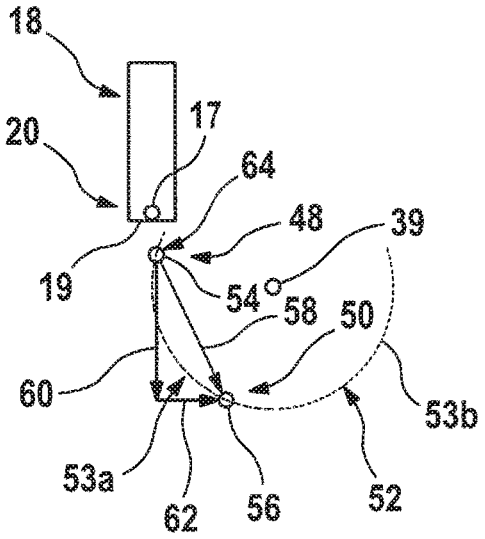
FIG. 3B illustrates a displacement of a detection element of the sensor system of FIG. 3A.

FIG. 3B illustrates the displacement of detection element 64 along displacement path 52 of the sensor system of FIG. 3A. When lever element 36 is pivoted out of starting position 48 into end position 52, detection element 64 is displaced from a starting point 54 to an end point 56 along displacement path 52. The movement of detection element 64 may be represented by a motion vector 58. The movement or motion vector 58 of detection element 64 may be broken down into a first movement component 60 and a second movement component 62 which is orthogonal to first movement component 60. Based on a reference point 17 of sensor device 18 and/or based on an outer surface 19 of sensor device 18 which faces lever element 36 and/or its second end 40 and/or detection element 64 at least in starting position 48 of lever element 36, first movement component 60 is directed away from sensor device 18 and/or reference point 17 and/or outer surface 19, or first movement component 60 is directed in parallel to a normal vector of outer surface 19. In contrast, second movement component 62 extends orthogonally to the normal vector of outer surface 19. Reference point 17 of FIG. 3A may be selected analogously to reference point 17 of FIG. 2A.

During a displacement of detection element 64 out of end position 50 into starting position 48, motion vector 58, first movement component 60 and second movement component 62 are each directed in the opposite direction.

In the embodiment according to the present invention and shown in FIGS. 3A and 3B, first movement component 60 is greater, in absolute terms, than second movement component 62 during a displacement of detection element 64 along displacement path 52. This condition applies at least during a displacement of detection element 64 along a portion 53*a* of displacement path 52, in which detection element 64 is situated closer to sensor device 18 than in another portion 53*b* of displacement path 52, in particular in a portion of displacement path 52 in which detection element 64 is located closest to sensor device 18 compared to other portions. Portion 53*a* of displacement path 52 may denote an area in which lever element 36 may be moved within design boundaries, and portion 53*b* may denote a hypothetical extension of portion 53*a*, in which it is in fact not possible to pivot lever element 36 for mechanical design reasons. Within portion 53*a*, detection element 64 moves farther along first movement component 60 in parallel or antiparallel to the normal vector of outer surface 19 toward, or away, from sensor device 18 and/or reference point 17 and/or outer surface 19 than it moves along second movement component 62 orthogonally to the normal vector of outer surface 19 past sensor device 18 and/or reference point 17 and/or outer surface 19. This means that detection element 64 moves along displacement path 52 predominantly toward or away from sensor device 18.

The arrangement according to the present invention of sensor device 18 relative to lever element 36 may be referred to as sampling in the circumferential direction based on a pivoting or rotational movement of lever element 36 along displacement path 52. A sensing direction, i.e., a direction in which sensor element 20 of sensor device 18 essentially detects and/or ascertains detection element 64, extends transversely to a longitudinal extension direction of lever element 36, at least in starting position 48 of lever element 36. As a result of such an arrangement of sensor device 18 and such a sampling of detection element 64 in the circumferential direction, a precision of the ascertainment of the position of detection element 64 and/or of lever element 36 may advantageously be achieved. Furthermore, compared to a radial sampling, a larger change of a measuring signal, per displacement path, ascertained by sensor device 18 may advantageously be achieved, so that it is possible to determine a position and/or a location of detection element 64 and/or of the lever element, and thus a position and/or a location and/or an opening angle of gas exchange valve 16, more precisely.

Furthermore, a sampling in the circumferential direction may be easier to implement in terms of the design than a radial sampling, since a collision risk of sensor device 18 with other components of gas exchange valve 16 may exist in the case of a radial sampling. Attachment tolerances or installation tolerances of the sensor device may also influence a signal accuracy in the case of radial sampling, so that a sampling in the circumferential direction may be considerably less sensitive to attachment or installation tolerances.

One aspect of the present invention may be summarized as follows. The movement and/or the displacement of detection element 64 along portion 53*a* of displacement path 52 may denote a vector or motion vector 58 between starting point 54 and the end point of the displacement of detection element 64 along displacement path 52, or the movement may be represented by vector 58. The movement may thus similarly denote a net movement of detection element 64 from starting point 54 to end point 56. If starting point 54 is located farther away from sensor device 18 than end point 56, detection element 64 is moved toward sensor device 18, which may result in a closing of gas exchange valve 16, for example. In contrast, if starting point 54 is located closer to sensor device 18 than end point 56, detection element 64 is moved away from sensor device 18, which may result in an opening of gas exchange valve 16, for example. The movement or the displacement of detection element 64 along displacement path 52 may include first movement component 60 in the direction of sensor device 18, or in the opposite direction, and second movement component 60 orthogonal to first movement component 60 and/or be broken down into first and second movement components 60, 62. For example, the direction of first movement component 60 may be in parallel or antiparallel to the normal vector of outer surface 19 of sensor device 18 which faces lever element 36. If detection element 64 is displaced from starting point 54 to end point 56, first movement component 60 in the direction of sensor device 18 and/or of outer surface 19 of sensor device 18 (or in the opposite direction) is greater, in absolute terms, than second movement component 62 in the arrangement according to the present invention of sensor device 18 relative to detection element 64 and/or to lever element 36. Accordingly and/or equivalently, detection element 64, during its displacement, is predominantly moved toward, or away from, sensor device 18.

Figure 4:
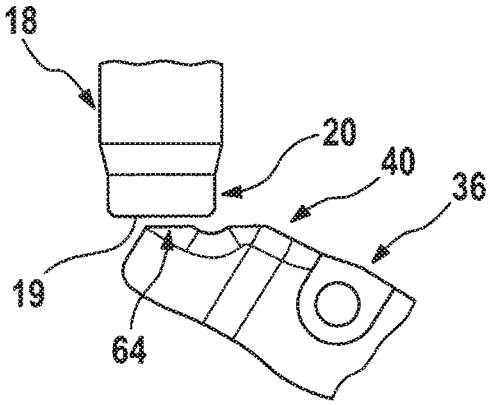
FIG. 4 shows a part of a lever element and of a sensor device for a reciprocating piston internal combustion engine according to one specific embodiment of the present invention.

FIG. 4 shows a part of a lever element 36, which is designed as a roller cam follower, and of a sensor device 18 for a reciprocating piston internal combustion engine 10 according to one specific embodiment of the present invention. Unless described otherwise, lever element 36 shown in FIG. 4 and sensor device 18 may have the same features and elements as the corresponding components shown in FIGS. 2A through 3B.

Sensor device 18 and/or sensor element 20 designed as a Hall-effect sensor are able to detect a distance from an edge of lever element 36 via a magnetic flux, for example. In the case of a lateral offset of sensor element 20 relative to lever element 36, the magnetic flux may change accordingly strongly, which in turn may influence signal quality. To increase the signal quality, second end 40 of lever element 36 may thus have a flattened design and/or have a flattened area, which may serve as detection element 64. In the flattened area, an outer surface of lever element 36 may extend in parallel to the outer surface of the sensor device, for example, at least in starting position 48 of lever element 36. Detection element 64 may also be designed as a flattened tip of lever element 36. In this way, a lateral offset of sensor element 20 and/or of sensor device 18 relative to lever element 36 may have only little influence on the signal quality, or a reliability and/or precision of the ascertainment of the position of detection element 64 may be increased.

Figure 5:
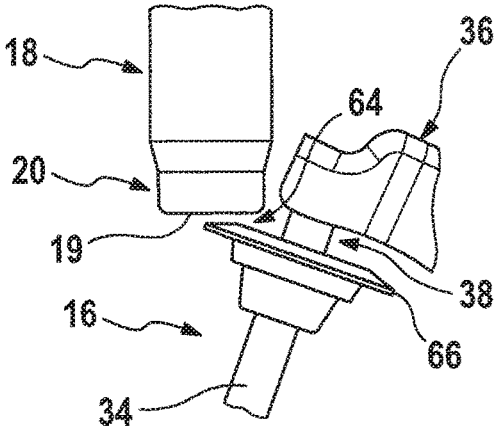
FIG. 5 shows a part of a lever element, of a gas exchange valve and of a sensor device for a reciprocating piston internal combustion engine according to one specific embodiment of the present invention.

FIG. 5 shows a part of a lever element 36 of a gas exchange valve 16 and of a sensor device 18 for a reciprocating piston internal combustion engine 10 according to one specific embodiment of the present invention. Lever element 36 is designed as a roller cam follower. Unless described otherwise, the components shown in FIG. 5 may have the same features and elements as the corresponding components shown in FIGS. 2A through 4.

As shown in FIG. 5, it is also possible, as an alternative or in addition to the embodiments of FIGS. 3A through 4, to use at least one portion of a valve disk 66 as detection element 64. For example, valve disk 66 may be designed for locking a valve spring and surround valve stem 34 in an annular manner in the area of second end 38 of valve stem 34 along an outer circumference of valve stem 34. For example, an edge area of valve disk 66 may serve as detection element 64. Valve disk 66 may be made from ferromagnetic material for this purpose.

It is also conceivable to situate a detection element 64 as a separate component made from ferromagnetic material on valve disk 66, valve stem 34 and/or lever element 36, whose displacement along displacement path 52 may be detected by sensor device 18. For example, detection element 64 may be designed as a projection.

Figure 6:
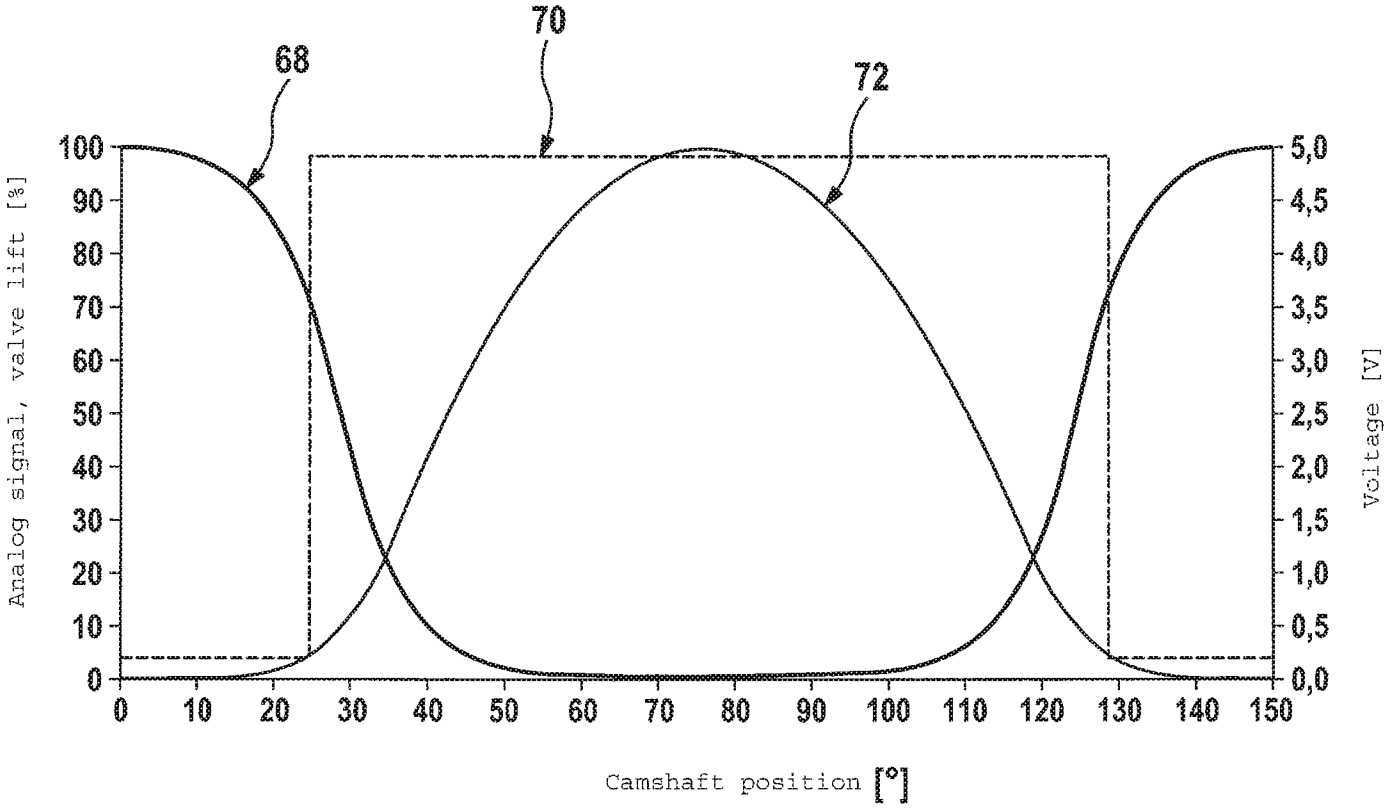
FIG. 6 shows an analog and a digital sensor signal of a sensor device and a valve lift of a gas exchange valve in each case as a function of a position of a camshaft for a reciprocating piston internal combustion engine according to one specific embodiment of the present invention.

FIG. 6 shows an analog sensor signal 68 and a digital sensor signal 70 of a sensor device 18 and a valve lift 72 of a gas exchange valve 16 in each case as a function of a position of a camshaft 44 for a reciprocating piston internal combustion engine 10 according to one specific embodiment of the present invention. FIG. 6 may thus be considered to be a representation of the timing of gas exchange valve 16. Analog sensor signal 68 and valve lift 72 are indicated in % on the y axis on the left of FIG. 6, each standardized to a maximum value. Digital sensor signal 70 is indicated as a voltage in volt on the y axis on the right of FIG. 6, and the position of camshaft 44 is plotted in units of angular degrees of camshaft 44 or in degrees of camshaft angle on the x axis. All values indicated in FIG. 6 are purely of an exemplary nature and shall not be considered to be limiting.

A rest position or starting position 48 of lever element 36, and correspondingly a rest position of gas exchange valve 16, may correspond to a closed gas exchange valve 16 and/or a position of the camshaft at 0° and/or 150°. In the rest position of gas exchange valve 16, sensor device 18, or outer surface 19 of sensor device 18 which faces lever element 36 in starting position 48 of lever element 36, may be spaced apart from detection element 64 by approximately 1.0 mm, for example. In other words, the sensor device may be installed with a nominal air gap of approximately 1.0 mm from detection element 64.

An area of analog sensor signal 68 having a maximum slope may be at approximately 0.5 mm to 1.0 mm of the mechanical valve lift of gas exchange valve 16, or of the distance of outer surface 19 of sensor device 18 from detection element 64 and/or from lever element 36. The area having the maximum slope of analog sensor signal 68 may be deliberately selected as the area of a switching threshold of digital sensor signal 70 to be able to reach a maximum accuracy. This is primarily due to the fact that, in the area of the maximum slope of analog sensor signal 68, a small change in the position of camshaft 44 causes a large change in analog sensor signal 68, so that the position and/or location and/or the opening angle of gas exchange valve 16 may be determinable with high accuracy. The switching threshold of digital sensor signal 70 may, for example, be in a range between 90% and 30% of analog sensor signal 68. The switching threshold is preferably around 70% of analog sensor signal 68, both in the case of a falling edge, which may correspond to an event "gas exchange valve 16 opens", and in the case of a rising edge, which may correspond to an event "gas exchange valve 16 closes." Digital sensor signal 70 of sensor device 18 may be transmitted via digital interface 26, for example, to a control unit, for example an engine control unit, and be processed by the same. The switching threshold of digital sensor signal 70 may advantageously be set at approximately 0.5 mm of the mechanical valve lift of gas exchange valve 16 or of the valve lift of valve head 30 of gas exchange valve 16 since, starting at this valve lift, an opening cross section and/or opening angle of gas exchange valve 16 corresponding to this valve lift may be sufficiently large for a flow which is relevant for a charge cycle of cylinder 12 to begin or set in.

In closing, it shall be pointed out that terms such as "including," "having" etc. do not exclude other elements or steps, and that terms such as "a" or an do not exclude a plurality. It shall moreover be pointed out that features which were described with reference to one of the above-mentioned exemplary embodiments may also be used in combination with other features of other above-described exemplary embodiments. Reference numerals in the claims shall not be regarded as limiting.

What is claimed is:

1. A reciprocating piston internal combustion engine, comprising:

a gas exchange valve having a valve head which is situated at a first end of a valve stem; a lever element which engages at a second end of the valve stem and which is configured to actuate the gas exchange valve by displacing the valve head; a detection element which, upon actuation of the gas exchange valve, is displaced along a displacement path; and a sensor device configured to ascertain a position of the detection element, wherein the sensor device is situated so that the detection element, during a displacement along a portion of the displacement path in which the detection element is situated closer to the sensor device than in other portions of the displacement path, moves predominantly in one path component of two path components in a movement one of toward the sensor device or away from the sensor device;

wherein the detection element samples data in a circumferential direction based on a pivoting or rotational movement of the lever element along the displacement path, and wherein at least one portion of a valve disk is used as the detection element.

2. The reciprocating piston internal combustion engine as recited in claim 1, wherein the lever element includes one of: (i) a flattened area, so that an outer surface of the lever element extends in parallel to an outer surface of the sensor device, at least in a starting position of the lever element; (ii) the lever element includes a roller cam follower.

3. The reciprocating piston internal combustion engine as recited in claim 1, wherein the detection element is configured integrally with the lever element.

4. The reciprocating piston internal combustion engine as recited in claim 1, wherein the detection element is situated at one end of the lever element located opposite of a rotational axis of the lever element in the longitudinal extension direction of the lever element.

5. A reciprocating piston internal combustion engine, comprising:

a gas exchange valve having a valve head which is situated at a first end of a valve stem; a lever element which engages at a second end of the valve stem and which is configured to actuate the gas exchange valve by displacing the valve head; a detection element which, upon actuation of the gas exchange valve, is displaced along a displacement path; and a sensor device configured to ascertain a position of the detection element, wherein the sensor device is situated so that the detection element, during a displacement along a portion of the displacement path in which the detection element is situated closer to the sensor device than in other portions of the displacement path, moves predominantly in one path component of two path components in a movement one of toward the sensor device or away from the sensor device;

wherein the detection element samples data in a circumferential direction based on a pivoting or rotational movement of the lever element along the displacement path, wherein the detection element is situated at one end of the lever element located opposite of a rotational axis of the lever element in the longitudinal extension direction of the lever element, and wherein the detection element is situated on the valve stem.

6. The reciprocating piston internal combustion engine as recited in claim 5, wherein the detection element is configured integrally with a valve disk situated on the valve stem.

7. The reciprocating piston internal combustion engine as recited in claim 5, wherein the sensor device is configured to contactlessly ascertain the position of the detection element.

8. The reciprocating piston internal combustion engine as recited in claim 7, wherein the sensor device includes a Hall-effect sensor for ascertaining the position of the detection element.

9. The reciprocating piston internal combustion engine as recited in claim 7, wherein the sensor device includes a Hall-effect sensor having an integrated circuit, and at least one of an analog interface for outputting an analog sensor signal and a digital interface for outputting a digital sensor signal.

10. The reciprocating piston internal combustion engine as recited in claim 9, wherein the sensor device is configured to output the digital sensor signal at a valve lift of the valve head of the gas exchange valve of more than 2%.

11. The reciprocating piston internal combustion engine as recited in claim 9, wherein the sensor device is configured to output the digital sensor signal at a valve lift of the valve head of the gas exchange valve of more than 0.3 mm.

12. A reciprocating piston internal combustion engine, comprising:

a gas exchange valve having a valve head which is situated at a first end of a valve stem;

a lever element which engages at a second end of the valve stem and which is designed to actuate the gas exchange valve by displacing the valve head;

a detection element which, upon actuation of the gas exchange valve, is displaced along a displacement path; and a sensor device to ascertain a position of the detection element, the sensor device being situated so that the detection element, during a displacement along a first portion of the displacement path in which the detection element is situated closer to the sensor device than in other portions of the displacement path, moves predominantly in a movement toward the sensor device or away from the same, the detection element being situated on one end of the lever element;

wherein the one end is situated opposite of a rotational axis of the lever element in the longitudinal extension direction of the lever element, the detection element being displaced from a starting point to an end point along the first portion of the displacement path when the lever element is pivoted and the motion of detection element being representable by a motion vector, the motion vector including a first movement component and a second movement component which is orthogonal to the first movement component, relative to an outer surface of the sensor device facing the end of the lever element at the starting point of the lever element, the first movement component being directed in parallel to a normal vector of the outer surface and the second movement component being directed orthogonally to the normal vector of the outer surface, and, during a displacement of the detection element along the first portion of the displacement path, the first movement component being greater, in terms of absolute value, than the second movement component.

* * * * *